US005505739A

United States Patent [19]

Montesano

[11] Patent Number: 5,505,739

[45] Date of Patent: Apr. 9, 1996

[54] WORN WASH PROCESS FOR GARMENTS

[75] Inventor: Gene Montesano, Los Angeles, Calif.

[73] Assignee: Lucky Brand Dungarees, Inc., Vernon, Calif.

[21] Appl. No.: 292,844

[22] Filed: Aug. 19, 1994

[51] Int. Cl.[6] ..... D06C 11/00

[52] U.S. Cl. ..... 8/102; 8/137; 8/148; 8/158; 26/28

[58] Field of Search ..... 8/102, 137, 148, 8/158, 159; 26/28

[56] References Cited

U.S. PATENT DOCUMENTS 4,740,213 4/1988 Ricci ..... 8/108.1
4,951,366 8/1990 Geller ..... 26/28

*Primary Examiner*—Stephen Kalafut
*Assistant Examiner*—Alan D. Diamond
*Attorney, Agent, or Firm*—Lewis Anten; Amedeo Ferraro

[57] ABSTRACT

The method of the present invention is used to create an overall worn look with areas of heavy wear in specific areas of a new garment's fabric to simulate the wear that occurs from the normal wear of a garment over a prolonged period of time. The method of the present invention comprises the steps of sandblasting the fabric of the new garment to be treated in specific areas in which worn marks simulating areas of heavy wear are desired and treating the entire fabric so that it fades and additional random areas of wear are created. According to the method disclosed, areas of heavy wear occur only in those areas of the fabric which is directly exposed to sandblasting, while the remainder of the fabric obtains a random faded look such that the overall appearance of the new garment simulates that of an old garment that has been naturally worn for a prolonged period of time.

7 Claims, 5 Drawing Sheets

WORN WASH PROCESS FOR GARMENTS

BACKGROUND OF THE INVENTION

1. Field of the Invention

This invention relates to a method for treating fabric to create an overall worn look with specific areas of heavy wear in the fabric and the end-product obtainable by means of such method.

2. Description of the Related Art

At present there exists a trend in which garments that are highly distressed and have a "used" or "worn look" are fashionable. This fashion trend has created a high demand for previously worn clothing. The most desired previously worn garments are denim Jeans which exhibit visible heavy wear in particular areas such as the pockets, knees, hip, buttock, and crotch areas for example. The pockets of such previously worn jeans typically also have visible areas of heavy wear normally created by an object that is carried within the pocket such as a wallet, keys, or a container of chewing tobacco for example. Such visible areas of heavy wear are usually outlines of the object that is contained within the pocket and are created on the exterior of the pocket from repeated wear of the garment. As the supply of previously worn clothing is limited and as the wearing of garments previously worn by another person is unappealing to many people, it is desired to simulate the above-described used or worn look on new fabrics.

In the past, there have been successful efforts in the garment industry to create a "faded look" in garments such as garments made of denim cloth. One example of such a method is disclosed in U.S. Patent application Ser. No. 4,740,213 issued to Ricci on Apr. 26, 1988. The Rice Patent discloses a method for creating a random faded effect on cloth through a process in which the cloth is bleached in a dry state utilizing granules of pumice impregnated with a fluid having powerful bleaching properties. This process, which is commonly known as the "stone-wash" process, creates irregular faded patches that vary in intensity and color shading and are distributed in a non-uniform manner over the entire expanse of the fabric being treated. However, no means is disclosed for creating a worn look with heavy wear in a specifically designated area or areas of the fabric.

Therefore, there exists a need for a method for producing a "worn look" in a new garment in which specific areas of a garment may be treated to create areas of highly visible heavy wear to simulate the areas of heavy wear that would naturally occur in the garment from a prolonged period of wear.

OBJECTS OF THE PRESENT INVENTION

It is an object of the present invention to provide a method for easily creating a worn look in specific areas of the fabric of a new garment that simulates the areas of wear that would naturally occur from a prolonged period of wear.

It is another object of the present invention to provide an end-product obtainable by a method for creating a worn look on specific areas of fabric of a new garment that simulates the areas of wear that would naturally occur from a prolonged period of wear.

It is a further object of the present invention to provide a method for easily creating the worn look on the fabric of a new garment that simulates the look of a naturally worn garment that does not significantly alter the integrity of the fabric and is inexpensive and easy to produce.

These and other objects of the present invention will become apparent from a review of the accompanying drawings and the detailed description of the drawings.

SUMMARY OF THE INVENTION

The present invention is directed to a method for treating fabric to create a "worn look" with specific areas of visible heavy wear in new garments, such as denim jeans and the like, and the end-product obtained by the implementation of such a method. For example, the method of the present invention may be used to treat the exterior of the fabric of a pocket to create an area of heavy wear that simulates the wear pattern that is naturally created on the fabric from an object contained in that pocket such as a wallet, keys or a container of chewing tobacco for example, for a prolonged period of time. As another example, the method of the present invention may be used to create an area of heavy wear that simulates the natural creases that occur from the prolonged wearing of a garment in a specific area of the garment such as, but not limited to, the inseam and crotch area of pants. The entire garment is then treated to create an overall worn look.

The method of the present invention for creating an overall worn look with specific areas of heavy wear in a garment comprises the steps of sandblasting the fabric of the garment to be treated in specific areas in which worn marks simulating areas of heavy wear are desired and treating the entire fabric so that it fades and additional random areas of wear are created. Typically, in the method of the present invention, the fabric to be treated is placed onto a flat surface with the surface of the fabric to be treated exposed. The areas of the fabric in which heavy wear is desired, are sandblasted until the amount of wear in that area is achieved. The second step for creating an overall worn look of the garment is a stone-wash process in which the entire fabric is treated so that it fades and additional random worn marks are created to give the garment an overall worn look. Such a stone-wash process is disclosed in U.S. Pat. No. 4,740,213 issued to Ricci on Apr. 26, 1988, and is incorporated herein by reference.

According to the method disclosed, areas of heavy wear are created only in the area of the fabric which is directly exposed to sandblasting, while the remainder of the fabric obtains a random faded look such that the overall appearance of the garment simulates that of a garment that has been naturally worn for a prolonged period of time.

DETAILED DESCRIPTION OF THE DRAWINGS

Figure 1:
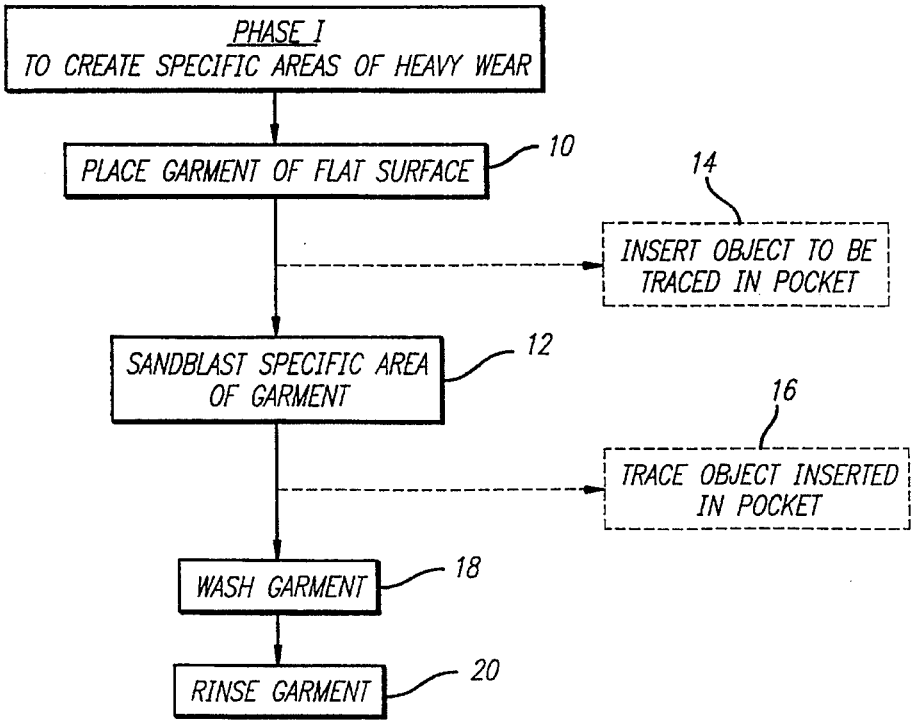
FIG. 1 is a block diagram illustrating the steps of the worn look method of the present invention for creating specific areas of heavy wear on the fabric of a garment.
Figure 2:
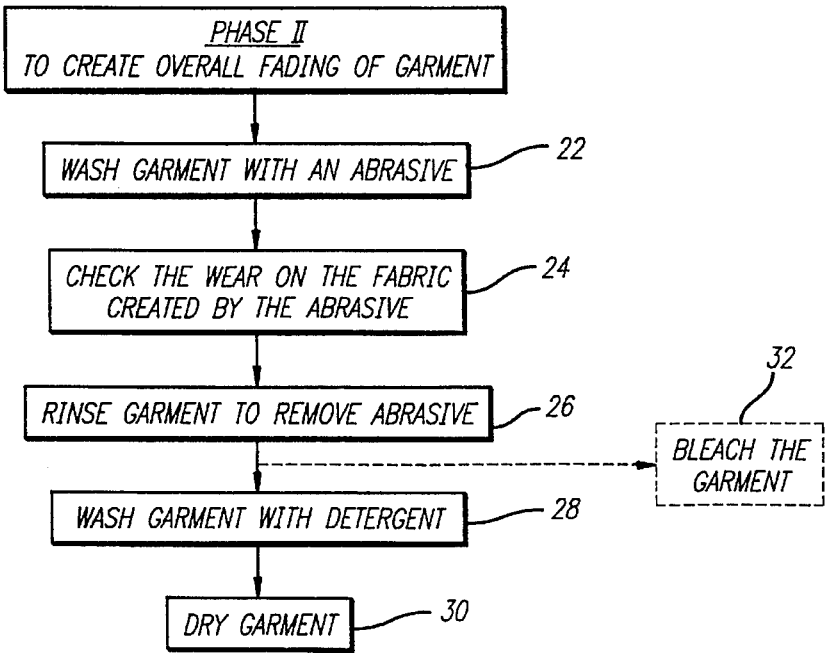
FIG. 2 is a block diagram illustrating the steps of the method of the present invention for creating the overall fading of a garment.

Referring to FIGS. 1 and 2, the steps of the preferred embodiment of the method for creating the worn look on a garment of the present invention are shown in block diagram form. The method of the present may be divided into two separate phases: Phase I for creating specific areas of heavy wear on a garment, and Phase II for creating an overall fading of a garment. In Phase I, the steps of creating a specific area of heavy wear on a garment comprise the step 10 of placing a garment on a flat surface. Next is the sandblasting step 12 in which the garment is sandblasted in specific areas in which heavy wear is desired. In the preferred embodiment, the sandblasting step 12 utilizes a hose for delivering under pressure an abrasive material to the surface of the fabric. Typically, the hose uses a T-137-3P nozzle for delivering the abrasive material, such as a #36 garnet, under thirty pounds of constant pressure directly to the fabric of the garment. In the preferred embodiment, the sandblasting step 12 is conducted by hand such that an operator can easily detect the change in the texture and color of the fabric being treated until the desired degree of heavy wear is achieved. It is appreciated that for larger areas of fabric, a larger type of nozzle, such as SLVE-4P nozzle for delivering an abrasive at eighty pounds of pressure may be used. Such a nozzle will be utilized when a larger area, such as the front half and the back hip area of a pair of pants, is desired to be treated.

As an alternative, prior to the sandblasting step 12, the method of the present invention may include the step 14 of inserting an object to be traced, such as a metal die, beneath the fabric or into a pocket of the garment. The sandblasting step 12 could also include the step 16 of tracing the object inserted into the pocket to create areas of heavy wear on the outside of the pocket corresponding to and outlining the shape of the object inserted into the pocket.

In step 18 the garment is washed in a rinsing machine such as a 900 lbs. 4 Pkt. Ellis Washer 55 lbs./pkt. and the following solvents, commercially available from Interstate Chemical Corporation, Cerritos, Calif.: 2% IC Lube 500, 1% IC Wetting 200, 1% IC Desizing Extra N are added to about 300 gallons of water at approximately 140 degrees Fahrenheit for approximately 15 minutes. The water is then drained from the rinsing machine. In step 20 the garment is rinsed in the rinsing machine with 300 gallons of clean water at 100 degrees Fahrenheit for approximately 5 Minutes and then drained. The garment is then removed from the rinsing machine.

Referring to FIG. 2, in Phase II, an overall fading of a garment includes the step 22 of washing garment with an abrasive material. In the preferred embodiment of the method of the present invention, the garment is placed into an abrasive washer, such as the 900 lbs. Hydro Flow washer with an abrasive material such as 40 lbs. of pumice stone in each pocket. The abrasive washer is filled with approximately 180 gallons of water at approximately 140 degrees Fahrenheit to which the following solvents are added: 2% IC Nutra Soft 777 softener, 1% IC White Whiter Co., 2% IC Lube 500 OL and the abrasive washer is run for approximately 65 minutes.

Next, in step 24, the wear on the fabric created by the abrasive is compared to a reference sample. Next is step 26 for rinsing the garment to remove the abrasive material from the garment. The water is drained from the abrasive washer and the abrasive washer is filled again with approximately 300 gallons of cold water at about 60 to 70 degree Fahrenheit and the abrasive washer is run for about 5 minutes before it is drained. The garment is removed from the abrasive washer and the abrasive material is removed from the pockets.

Next, in step 28 the garment is washed with detergent in a washing machine such as a 4 pkt. Valley Washer. The washing machine is filed with about 300 gallons of water at 140 degrees Fahrenheit with a detergent such as 2% IC supreme white 413, and is run for approximately 5 minutes and then drained. The washing machine is filled with about 300 gallons of water at approximately 120 degrees Fahrenheit and the washing machine is run for approximately 5 minutes and drained. The washing machine is then filled with approximately 180 gallons of water at 120 degrees Fahrenheit in which a ½% acetic acid, 80% solution and a softener such as 2% IC soft C.J.S. commercially available from Interstate Chemical Corporation, Cerritos, Calif. is added and run for approximately 10 minutes and drained. The garment is then removed from the washing machine and put into an extractor machine for approximately 5 minutes to wring the excess water from the garment.

Next is step 30 for drying the garment. The garment is taken from extractor and placed into a conventional tumble dryer at 300 degrees Fahrenheit and run for approximately 30 minutes until dry.

Optionally, for increased fading of the garment the method of the present invention may include a bleaching step 32 in which a washing machine, such as a 4 pkt. Valley Washer, is filled with approximately 300 gallons of water at approximately 140 degrees Fahrenheit and is run for 5 minutes and then drained. The washing machine is then filled with about 300 gallons of water at approximately 140 degrees Fahrenheit to which is added a 4% soda ash dense and a bleach, such as 15% hyphoclorite, and the washing machine is run for approximately 10 minutes to match the color of the garment with the reference sample and then drained. The washing machine is then filled with approximately 300 gallons of water at approximately 140 degrees Fahrenheit with a 2% sodium metabisulfite solution and is run for approximately 5 minutes and then drained.

Figure 3:
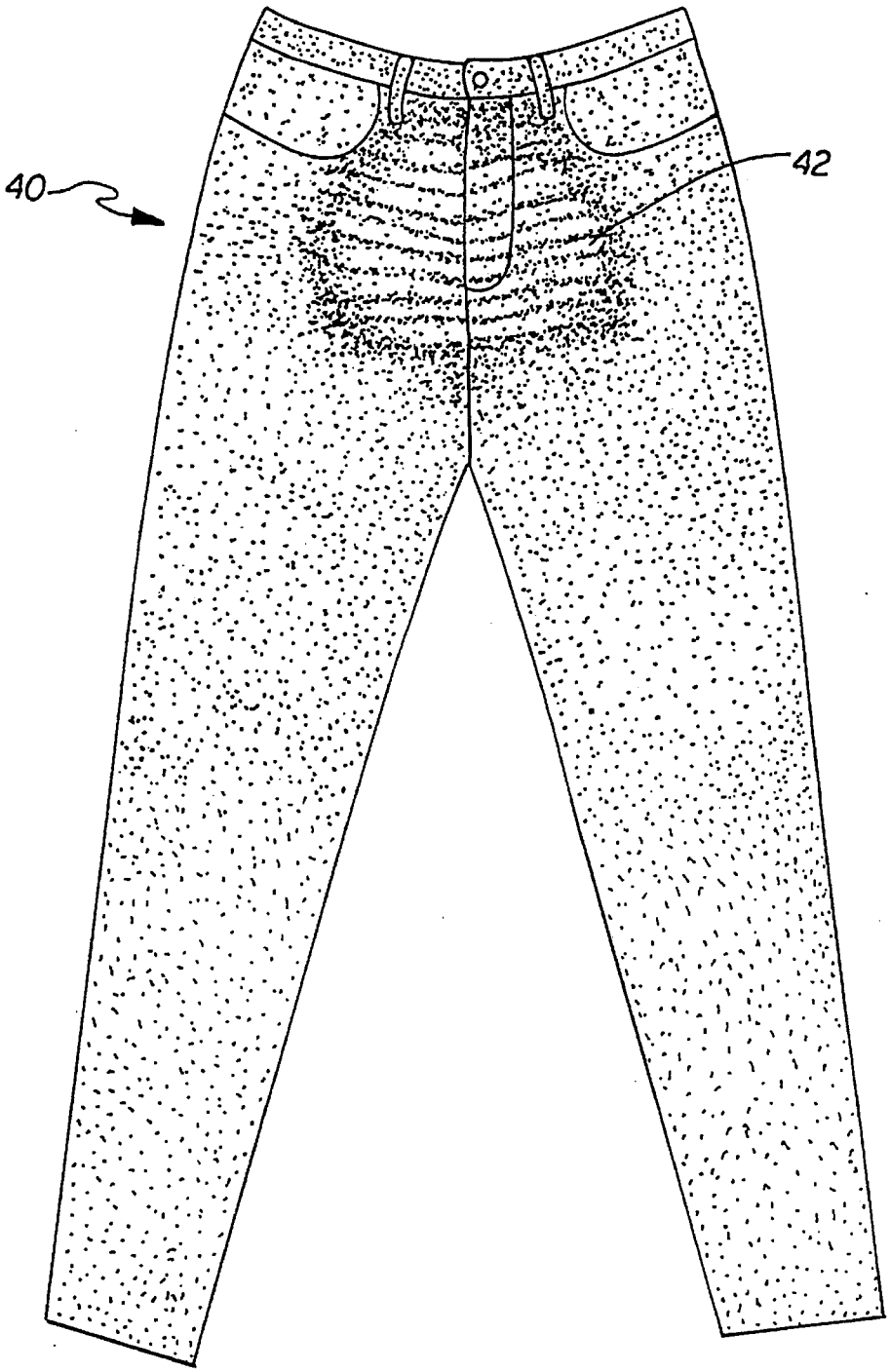
FIG. 3 is the front view of a schematic representation of a pair of pants obtained as the end-product of the method of the present invention illustrating areas of heavy wear in the crotch area of the pants.

Referring to FIG. 3, a garment such as a pair of pants 40 is shown having an area of heavy wear 42 in the crotch area of the pants 40 to simulate the natural wear that occurs in the creases in that area for a pair of pants that have been worn for a prolonged period of time. The area of heavywear 42 is created via the sandblasting process in Phase I of the method described above. The sandblasting process to create the area of heavy wear 42 is conducted by hand such that an operator can easily detect the change in the texture of the surface of the fabric until the desired wear pattern is achieved. The pants 40 are then treated with a fading process, such as the process described in Phase II above.

Figure 4:
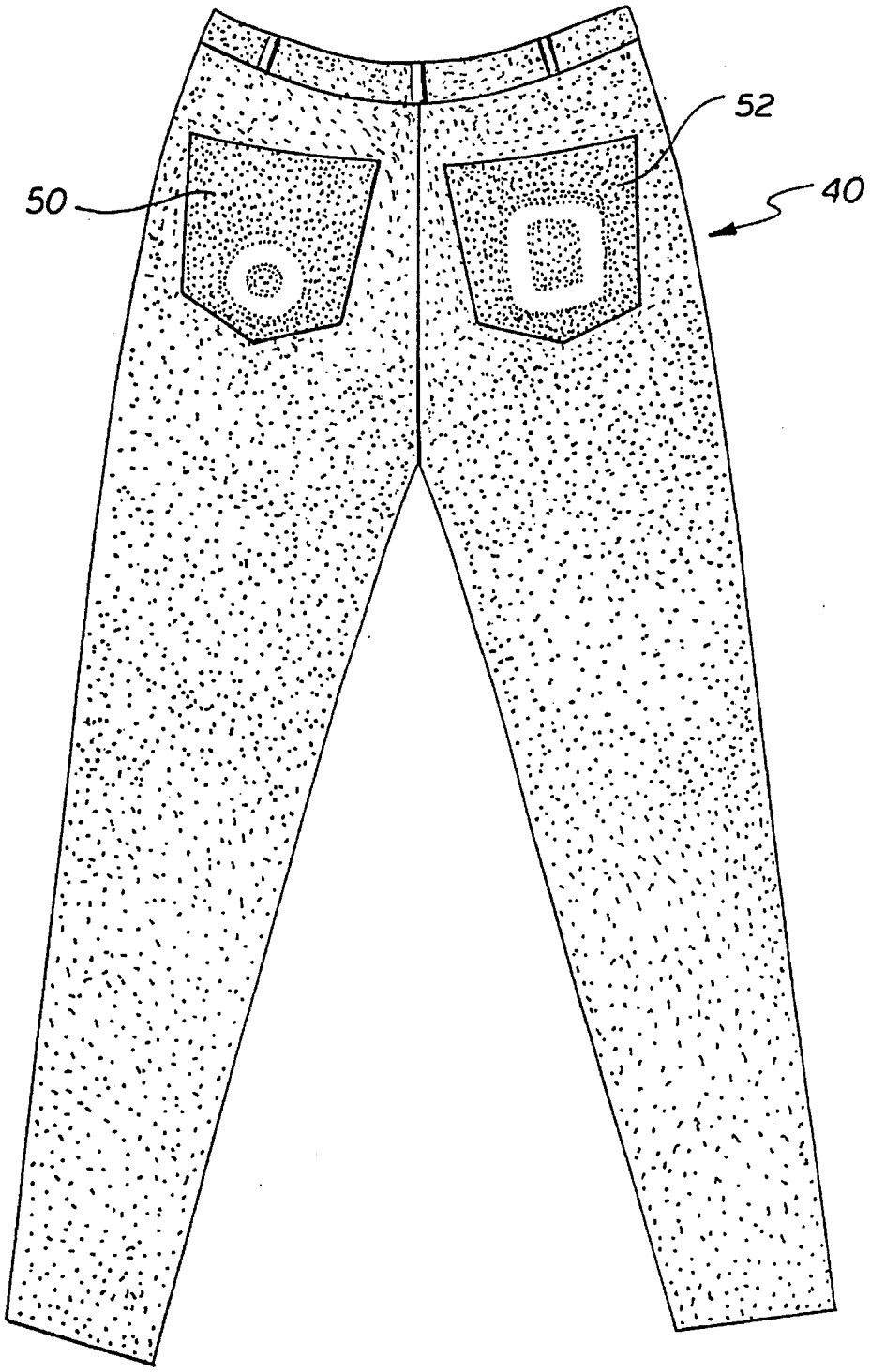
FIG. 4 is a rear view of a schematic representation of a pair of pants shown in FIG. 3 obtained as the end-product of the method of the present invention, illustrating areas of heavy wear in the pockets.

Referring to FIG. 4, the rear view of the pants 40 is shown. The pants 40 have pockets 50 and 52 which have areas of heavywear outlining an object that was contained in the pocket of the pants while the pants were being worn. In pocket 50, the area of heavy wear is created by the outlining of a circular object during the sandblasting steps 12, 14, and 16 of the method described above. The second pocket 52, shows areas of heavy wear outlining a rectangular object in the pocket such as a wallet.

Figure 5:
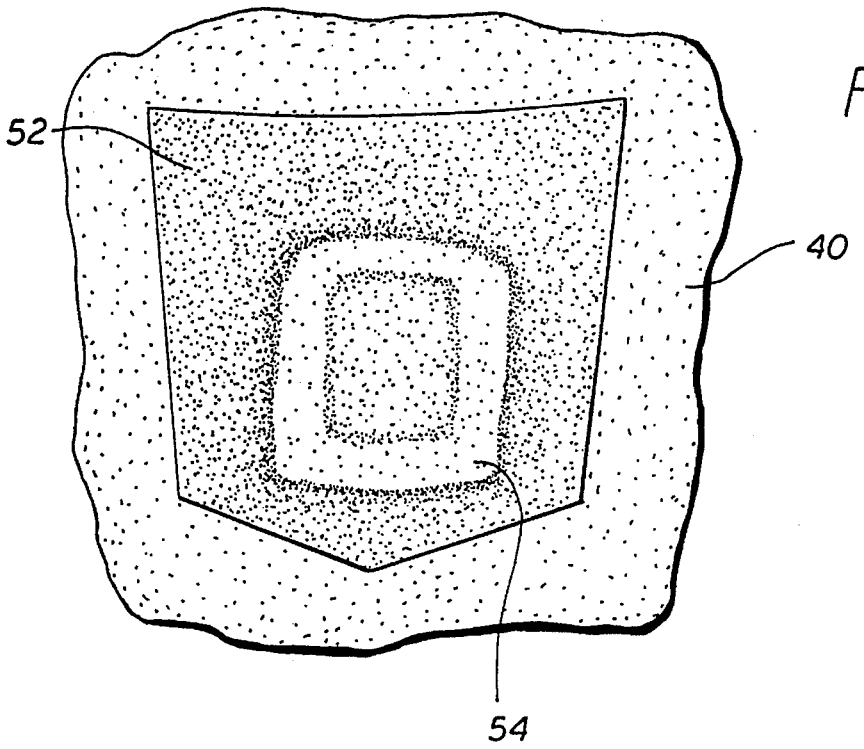
FIG. 5 is an enlarged fragmentary view of a first pocket of the pants in FIG. 4 having an area of heavy wear in the shape of a rectangle obtained by the method of the present invention.
Figure 6:
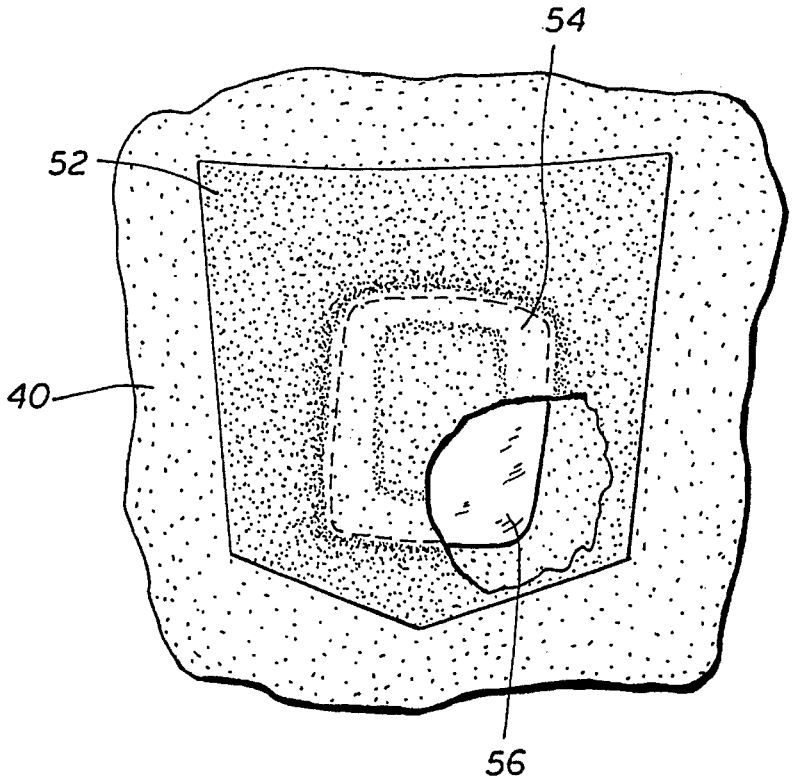
FIG. 6 is a partial cut-away of the pocket of FIG. 5 in which a wallet is inserted in the pocket and is used to form the area of heavy wear in the shape of a rectangle.

Referring to FIGS. 5 and 6, the pocket 52 is shown in greater detail. In order to create the area of heavy wear 54 outlining a wallet 56 contained in the pocket 52, the wallet 56 is first inserted in the pocket 52. The pants 40 are then sandblasted by hand with the wallet 56 remaining within the pocket 52 as described in steps 12, 14, and 16 of the method of the present invention. In order to create the area of heavy wear 54, the operator of the sandblaster traces the outline of the wallet 56 to create the area of heavy wear 54 to simulate the wear area that naturally occurs from prolonged use of a pair of pants with a wallet 56 in the pocket.

Figure 7:
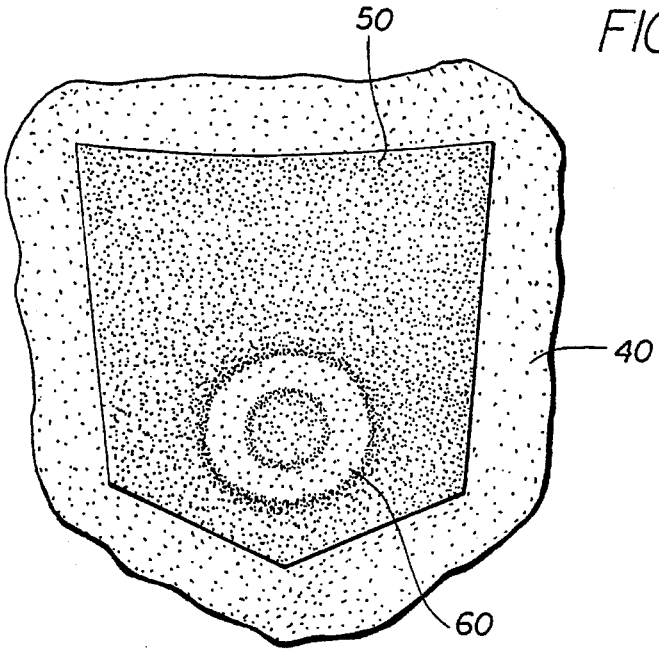
FIG. 7 is an enlarged fragmentary view of a second pocket of the pants in FIG. 4 having an area of heavy wear in the shape of a circle obtained by the method of the present invention.
Figure 8:
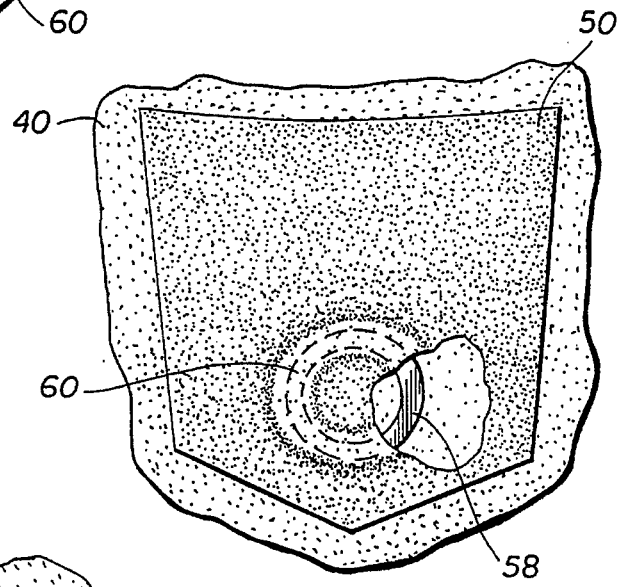
FIG. 8 is a partial cut-away view of the pocket of FIG. 7 in which a metal die is inserted in the pocket and is used to form the area of heavy wear in the shape of a circle.

Referring to FIGS. 7 and 8, the pocket 50 contains a circular object therein such as a section of a piece of hollow pipe 58. In the preferred embodiment, the section of hollow pipe 58 is placed within the pocket 50 of the pants 40 prior to treatment. The pants 40 are then sandblasted in accordance with steps 12, 14 and 16 of the method described above, with the section of hollow pipe 58 contained within the pocket 50 until the area of heavywear 60 is created to simulate the wear area that naturally occurs from the prolonged wearing of a pair of pants having a circular container such as a container for tobacco are created. It is appreciated that many different types of patterns can be created by the sandblasting process depending on what objects are placed within the pocket. Therefore the area of heavy wear that can be created is unlimited.

It is appreciated that the pocket 50 may be treated independently of the pants 40 and subsequently sewn to the pants 40. This would be accomplished by placing the object to be traced, such as the wallet 56 or the section of hollow pipe 58, beneath the fabric to be treated such that one surface of the fabric contacts that object and the other surface of the fabric is exposed to the sandblasting. Once the area of heavywear is created on the pocket 50, the pocket 50 may be attached to the desired garment.

While the preferred embodiment of the method of the present invention has been described as utilizing sandblasting for creating specific areas of heavy wear on a garment, it is appreciated that other well-known abrading means, such as sand paper and the like or sanding machines such as a belt sander and the like, may be used without departing from the scope of the present invention.

Although it is preferred to create the areas of heavy wear prior to the overall fading of the garment, it is further appreciated that the overall fading of the garment may be done prior to the step of sandblasting the garment in the specific areas in which wear are desired. In this case, the overall faded finish of the garment would have to be protected from the sandblasting. In order to protect the finish of the garment a template exposing only the area of the garment to be treated while protecting the remainder of the garment may be used for creating the specific areas of heavy wear during the sandblasting step.

Figure 9:
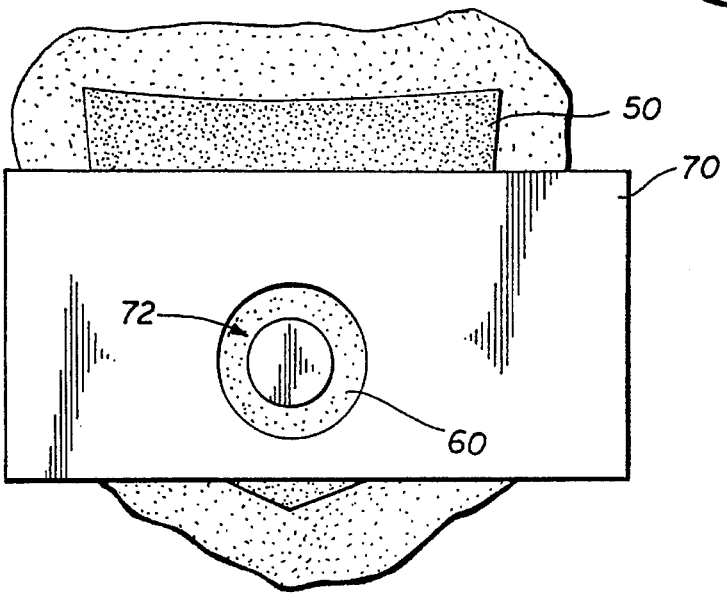
FIG. 9 is a top plan view of a template used to form an area of heavy wear in the shape of a circle in an alternative embodiment of the method of the present invention.

Referring to FIG. 9, as an alternative embodiment of the method of the present invention, a template 70 may be used to create the areas of specific wear during sand blasting. The template 70 comprises an opening 72 in the shape of the area of heavy wear desired to be created. The opening 72 has a width sufficient to permit the abrading of the area of the garment in which the heavy wear is desired while protecting the surrounding area. The template 70 has a sufficient thickness to endure the abrasive effects of sandblasting. It is appreciated that template 70 can be made in any size, shape, or form.

While the present invention has been described with respect to the preferred and alternative embodiments, it is appreciated that other variation of the present invention may be desired without departing from the scope of the present invention.

What is claimed is:

1. A method for creating specific areas of wear on the fabric of a new garment comprising the steps of:

(a) placing at least one die in the shape of an object to be traced with an abrasive means beneath a portion of the fabric of a garment; and (b) abrading the fabric above said die with an abrasive means to create an area of wear on the fabric, said area of wear corresponding in position to said die whereby a worn effect is created in the garment simulating wear marks naturally occurring in a garment from an object placed within a pocket while a garment is being worn.

2. The method of claim 1 in which the step of abrading the garment includes sandblasting.

3. The method of claim 1 in which the step of abrading the fabric includes tracing the die placed beneath the fabric to create an outline of the die on the exterior surface of the garment.

4. The method of claim 1 including the step of creating an overall fading of garment.

5. The method of claim 4 in which the step of creating an overall fading of the garment includes the steps of: (a) washing the garment with an abrasive material to create an overall faded appearance to the fabric of the garment in addition to said area of wear created by the step of abrading the fabric above said die; (b) checking the wear on the garment created by the abrasive material; (c) rinsing the garment to remove the abrasive material; (d) washing the garment with a detergent; and (e) drying the garment.

6. The method of claim 1 in which said die placed beneath the fabric is in the shape of a wallet.

7. The method of claim 1 in which said die placed beneath the fabric is a die in the shape of a container of chewing tobacco.

* * * * *